US005357633A

United States Patent [19]

Rael

[11] Patent Number: 5,357,633

[45] Date of Patent: Oct. 25, 1994

[54] ARM PROTECTIVE GARMENT

[76] Inventor: George V. Rael, 3945 Ruffin Ave. SW., Albuquerque, N. Mex. 87105

[21] Appl. No.: 22,144

[22] Filed: Feb. 25, 1993

[51] Int. Cl.[5] ..... A41D 13/08

[52] U.S. Cl. ..... 2/16; 2/59; 2/126

[58] Field of Search ..... 2/1.2, 16, 59, 114, 2/126, 125, 105, 106; 602/1, 3, 62

[56] References Cited

U.S. PATENT DOCUMENTS

| | | | |
|---|---|---|---|
| 417,028 | 12/1889 | Horn | 2/59 X |
| 1,117,077 | 11/1914 | Mooney | 2/16 |
| 1,424,215 | 8/1922 | Rowe | 2/59 X |
| 1,547,179 | 7/1925 | Martens | 2/158 X |
| 1,796,782 | 3/1931 | Gasperini | 2/59 X |
| 1,833,109 | 11/1931 | Day | 2/59 X |
| 2,904,792 | 9/1959 | Elliott | 2/59 X |
| 3,000,378 | 9/1961 | Zieman | 2/16 X |
| 3,329,144 | 7/1967 | Liman | 2/59 X |
| 3,416,518 | 12/1968 | Samuels et al. | 2/59 X |
| 3,837,007 | 9/1974 | Girest | 2/93 |
| 4,356,570 | 11/1982 | Vernon et al. | 2/16 |
| 4,569,087 | 2/1986 | Kerwin | 2/69 |
| 4,985,934 | 1/1991 | Perry | 2/125 |
| 5,056,157 | 10/1991 | Pryor | 2/59 X |

*Primary Examiner*—Jeanette E. Chapman
*Attorney, Agent, or Firm*—John R. Flanagan

[57] ABSTRACT

An arm protective garment includes an elongated tubular sleeve made of a flexible fabric and defining an elongated internal cavity extending between opposite ends. The sleeve is open at one end for slipping over a driver's hand and arm and for receiving the driver's arm in the internal cavity of the sleeve. The garment also includes a mitten of flexible fabric disposed on the other end of the sleeve and defining an internal pocket for receiving the driver's hand therein. The mitten has only a thumb opening defined therein for extension of the driver's thumb from the mitten. The garment further includes a flexible strap attached to the one open end of the sleeve for encircling the neck or chest of the driver for releasable reattachment to the one open end of the sleeve to retain the sleeve on the driver's arm.

8 Claims, 1 Drawing Sheet

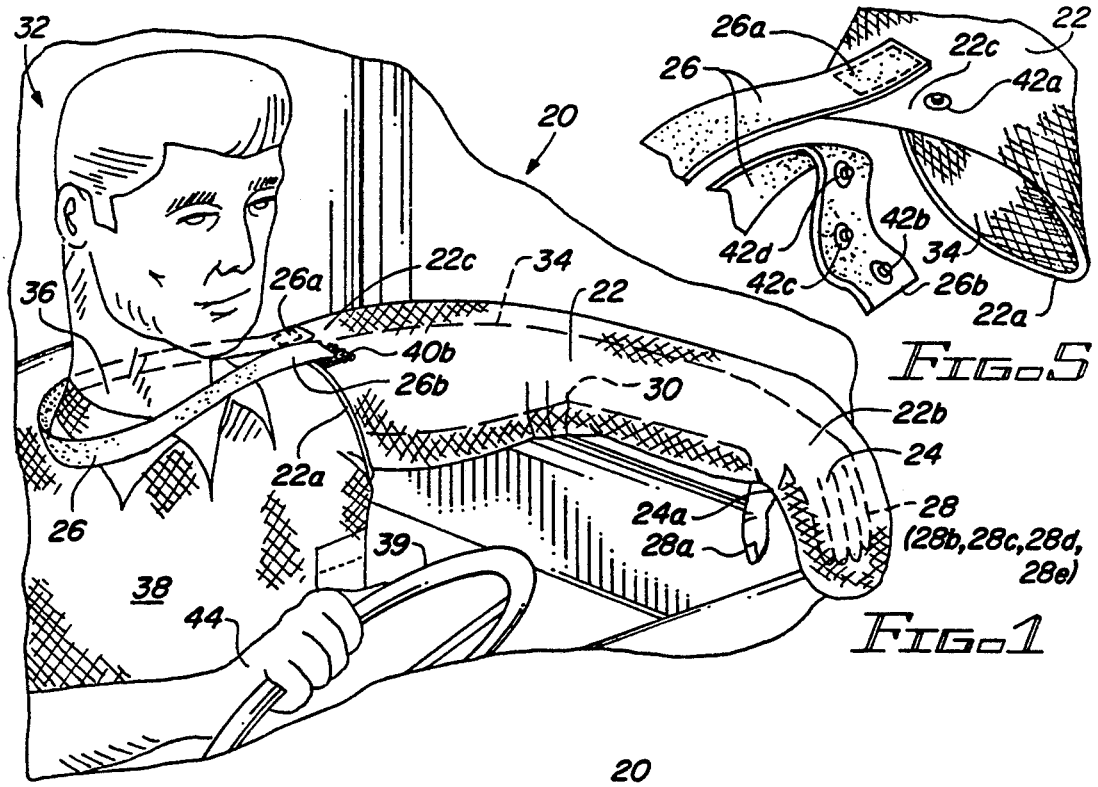
FIG. 1
FIG. 5
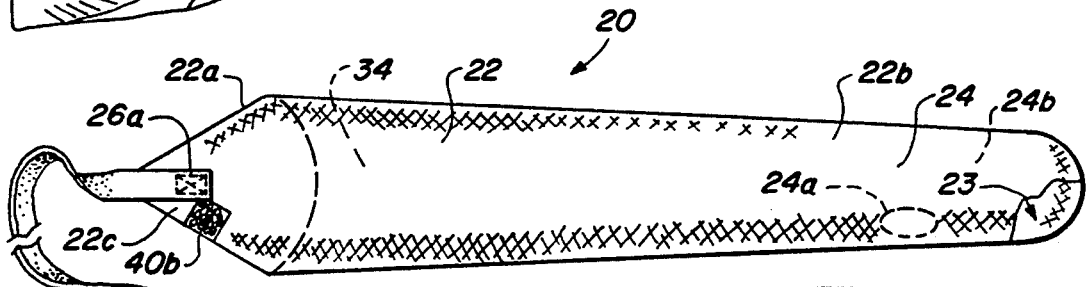
FIG. 2
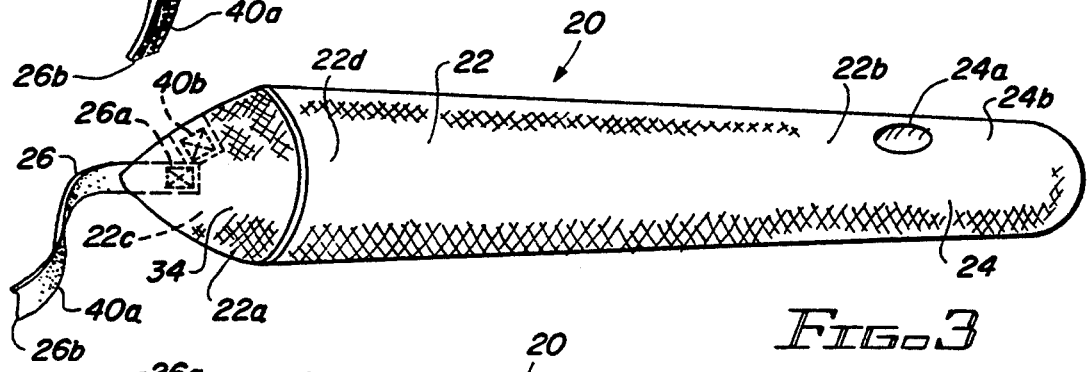
FIG. 3
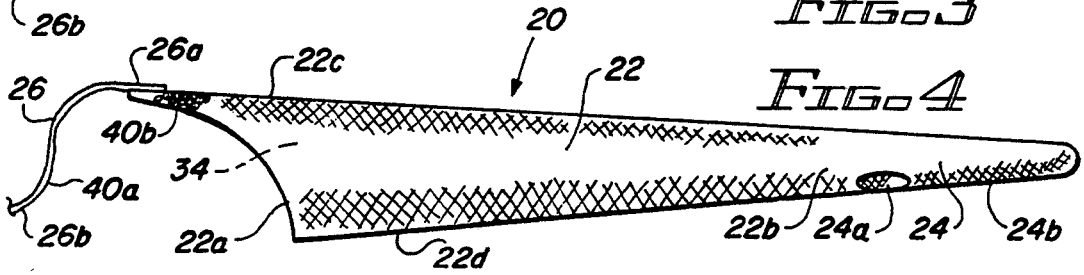
FIG. 4

ARM PROTECTIVE GARMENT

BACKGROUND OF THE INVENTION

1. Field of the Invention

The present invention generally relates to specialized limb garments and, more particularly, is concerned with an arm protective garment.

2. Description of the Prior Art

A variety of specialized needs have sparked the development in recent years of specific garments designed for a person's arms and legs individually as well as jointly. For example, a policeman directing night traffic must be visible to motorists. Athletes such as pitchers or quarterbacks must keep their throwing arms in optimum condition for greatest effectiveness in baseball or football games. An athlete's legs also often require specialized clothing to prevent cramps, sprains, etc.

Some representative examples of garments designed to meet such needs are disclosed in U.S. patents to Girest (3,837,007), Vernon et al (4,356,570), Kerwin (4,569,087), and Perry (4,985,934). The Girest garment addresses the policeman's needs for light-reflective clothing with a jacket having sleeves of reflectorized material or with a pair of such auxiliary sleeves attachable to a police jacket.

The garments disclosed in the Vernon et al, Kerwin and Perry designs all address the specific problems of athletes as hereinbefore described. The Vernon et al and Perry garments basically focus on an athlete's arm requirements with their designs of single-arm garments. These garments extend over one shoulder of the athlete for attachment either to the athlete's uniform or to straps encircling the athlete's chest or other shoulder. The Kerwin garment designs include both single limb garments, for arms and legs individually, as well as full jackets and pants. All of the aforementioned garments have thermal features for retaining limb warmth. The latter three designs include both thermal and cooling features for the athlete's limbs as needed.

The ordinary motorist may wish to particularly shield his hand and arm from sunburn while driving along on his or her usual daily route, or on longer vacations drives. Air conditioning is great, but driving on a lovely day with one's arm resting on the ledge of an open car window is found enjoyable by many drivers. The driver's enjoyment, however, can be shattered if the drive results in a severe sunburn to the hand or arm.

The garment designs hereinbefore described disclose some features beneficial to the driver's needs. A single-arm type of garment would be most useful since usually, for drivers, the left hand and arm is the most likely to be sunburned. However, none of the designs described above addresses the problem of sunburn prevention. No protective coverage for the hand is provided by any of the garments. Each of the athlete's garments basically focuses on the athlete's need either to retain or dispel body warmth. Additionally, the single-arm garments disclosed in the Girest policeman's garment and the Vernon et al athletic garment require attachable fastening features on the person's underlying shirt or jacket.

Consequently, a need still exists for a single-arm garment which would shield both a driver's hand and arm from sunburn. The garment should be fabricated of sun-resistant, durable, washable material and of simple design and construction for easy wearability by a driver. The simplicity of design and construction would also ensure inexpensive manufacture of the garment.

The garment should be foldable to a compact size for easy storage and transport.

SUMMARY OF THE INVENTION

The present invention provides an arm protective garment which is designed to satisfy the aforementioned needs by avoiding the drawbacks of the prior art without introducing other drawbacks. Instead, the garment of the present invention provides expanded capabilities not available in the prior art garments.

One capability is the simplicity in design and construction of the garment for inexpensive manufacture of the garment and for easy wearability by a driver. A second capability is the total coverage of the driver's hand and arm (excluding the thumb only) provided by the garment so as to prevent sunburn of the hand and arm. A third capability is the sun-resistant, durable, washable fabric of the garment for additional protection against sunburn of the hand and arm and for easy maintenance of the garment. A fourth capability is the thumb opening in the mit of the garment, permitting the driver free use of the thumb in grasping the steering wheel as needed with the mit-enclosed hand. A fifth capability is the simple attachability of complementary fastening elements for easy securement of the garment in place and for removal of the garment. A sixth capability in the compact foldability of the garment for easy storage and transport.

Accordingly, the present invention is directed to a an arm protective garment which comprises: (a) an elongated tubular sleeve of flexible material having a pair of opposite ends and defining an elongated internal cavity extending between the opposite ends, the sleeve being open at one of the opposite ends for slipping over a hand and arm of a person and for receiving and enclosing the arm in the internal cavity thereof; (b) means defining a mitten disposed on the other of the opposite ends of the sleeve and defining an internal pocket for receiving and enclosing the hand of the person therein, the mitten having a thumb opening defined therein for extension of a thumb on the hand of the person from the mitten; and (c) means for encircling a body portion, such as the neck or chest, of the person adjacent to the arm of the person to releasably retain the sleeve and mitten on the arm and hand of the person. The encircling means is an elongated strap attached to the one open end of the sleeve and encircling the body portion of the peron and being releasably reattachable to the one open end of the sleeve to retain the sleeve on the arm of the person.

The elongated sleeve is formed integrally with the mitten. The sleeve and mitten are made of a durable, washable, sun-resistant fabric material so as to block sun rays from penetrating therethrough. This fabric material thereby aids in shielding the driver's hand and arm from sunburn. The durability and washability of the fabric material also ensures easy maintenance of the garment, thereby encouraging its frequent use by a driver.

The sleeve and mitten provide total coverage of the driver's hand and arm, excepting the driver's thumb only. This feature also aids in preventing sunburn to the hand and arm. The thumb opening is disposed on the bottom or inner side portion of the mitten so that it is thereby less likely that the driver's thumb will be exposed to the sun's rays. Additionally, the free use of the thumb permits the driver greater flexibility of motion, as needed, in grasping the steering wheel of the vehicle with the mitten-enclosed hand.

As hereinbefore stated, the strap is attached at a first end by stitching to the one open end of the sleeve. The strap is of sufficient length to encircle the neck (or of a greater length to encircle the chest, if preferred) and is then releasably reattached at a second end to the one open end of the sleeve. Also, complementary detachable fastening elements are disposed on the strap and on the one open end of the sleeve. In the preferred embodiment, a detachable patch of hook fastening material is disposed at the second end of the strap for releasable reattachment to a detachable patch of loop fastening material disposed at the one open end of the sleeve.

In an alternative embodiment, complementary snap and snap-receiving fastening elements are similarly disposed on the second end of the strap and the one open end of the sleeve. A plurality of snap fasteners may be disposed on the second end of the strap for selection of the snap most suitable for adjusting the strap to the driver's comfort.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 1 is a perspective view of an arm protective garment of the present invention, showing the garment worn over the hand and arm of a driver of a vehicle and secured by a strap of the garment.

FIG. 2 is a top elevational view of the garment, shown with complementary detachable patches of hook and loop fastening elements disposed on the strap and sleeve of the garment.

FIG. 3 is a bottom elevational view of the garment with the strap detached at one end from the sleeve of the garment.

FIG. 4 is a side elevational view of the garment shown with the strap detached at one end from the sleeve of the garment.

FIG. 5 is an enlarged fragmentary of the garment of FIG. 2, showing an alternative embodiment of the complementary detachable fastening elements disposed on the strap and sleeve of the garment.

DETAILED DESCRIPTION OF THE INVENTION

Referring to the drawings and particularly to FIGS. 1 and 4, there is illustrated an arm protective garment of the present invention, being generally designated 20. In its basic components, the arm protective garment 20 includes an elongated tubular flexible sleeve 22 open at one end 22*a*, a flexible mitten 24 disposed on the other end 22*b* of the sleeve 22, and a flexible strap 26 attached, such as by stitching, at one end 26*a* to the one open end 22*a* of the sleeve 22 and being releasably reattachable at the other end 26*b* to the one open end 22*a* of the sleeve 22.

The garment 20 is worn by extending the left hand 28 and arm 30 of a driver 32 through the open end 22*a* of sleeve 22 into an elongated internal cavity 34 defined by the sleeve 22 to have an overall configuration which generally tapers from the one open end 22*a* to the opposite other end 22*b* thereof, as seen in FIG. 4. As seen in FIG. 1, the sleeve 22 is of a length that only covers the arm 30 of the driver 32 by extending only up to and terminating at the one shoulder connected to the arm 30. As seen in FIGS. 3 and 4, the opening defined at the one end 22*a* of the sleeve 22 is disposed in a generally oblique relationship to the length of the sleeve so as to define an upper portion 22*c* projecting or protruding beyond a lower portion 22*d* of the one sleeve end 22*a*. The left hand 28 of the driver 32 is further extended into an internal pocket 23 defined by the mitten 24 disposed on the other end 22*b* of the sleeve 22. The sleeve 22 thus encloses the arm 30 and the mitten 24 encloses the hand 28, permitting only the thumb 28*a* to project outwardly through the thumb opening 24*a*. The attached strap 26 then encircles the neck 36 or chest 38, as selected, of the driver 32 and is releasably reattached to the sleeve 22 so as to retain the sleeve 22 on the arm 30 of the driver 32.

The sleeve 22 and mitten 24 are formed integrally with one another such that the sleeve 22 and mitten 24, as seen in FIGS. 2–4, constitute a continuous tubular enclosure with a closed terminal end portion and are made from a durable, washable, sun-resistant, preferably light-colored and densely-woven, flexible fabric. A suitable material for the fabric is cotton or a mixture of cotton and a synthetic material. The enclosed hand 28 and arm 30 of the driver 32 are thereby substantially shielded by the sleeve 22 and mitten 24 from the possibility of sunburn.

Referring particularly to FIGS. 3 and 4, the thumb opening 24*a* is disposed on a bottom or inner side portion 24*b* of the mitten 24. The thumb 28*a* is thereby free to project outwardly from the thumb opening 24*a*, as seen in FIG. 1, while the fingers 28*b*, 28*c*, 28*d*, 28*e* remain enclosed by the mitten 24. The outward projection of the thumb 28*a* permits the driver 32 to have greater flexibility of movement for grasping the steering wheel 39, as needed, with the hand 28 enclosed by the mitten 24 and the freely movable thumb 28*a*. The thumb opening 24*a* also serves to provide for some air ventilation through the mitten 24 and sleeve 22.

As hereinbefore briefly described and referring particularly to FIGS. 2–4, the strap 26 is made of a flexible fabric and, specifically, is attached by stitching at one end 26*a* to the protruding upper portion 22*c* of the sleeve 22 at the one open end 22*a*. In the preferred embodiment, as seen in FIG. 1, the strap 26 is of a length sufficient to encircle the neck 36 of the driver 32 so as to be releasably reattachable to the upper portion 22*c* of sleeve 22 at the one open end 22*a*. In an alternative embodiment, the strap 26 may be of a greater length so as to encircle the chest 38 of the driver 32 and then to be releasably reattached to the upper portion 22*c* of sleeve 22 at the one open end 22.

Referring particularly to FIGS. 1 and 2, in the preferred embodiment the strap 26 and sleeve 22 are provided with complementary patches 40*a*, 40*b* of detachable hook and loop fastening material. The patch 40*b* of detachable loop fastening material is disposed on an upper portion 22*c* of the sleeve 22 at the one open end 22*a* of the sleeve 22.

Referring particularly to FIG. 5, in an alternative embodiment the strap 26 and sleeve 22 are disposed with complementary detachable snap fastening elements 42*a*, 42*b*, instead of the complementary patches 40*a*, 40*b* of detachable hook and loop fastening material. The detachable snap-receiving element 42*a* is disposed on an upper portion 22*c* of sleeve 22 at the one open end 22*a* of sleeve 22. The detachable snap fastener element 42*b* is disposed on the end 26*b* of the strap 26. A plurality of snap fastener elements 42*b*, 42*c*, 42*d* may be disposed along the end 26*b* of strap 26, for selection of the most appropriate fastener element for adjusting the strap 26 to the comfort of the driver 32.

Referring again to FIGS. 1 and 2, after encircling the neck 36 or chest 38 of the driver 32, the strap 26 is secured at end 26*b* to the sleeve 22 by attachment together of the complementary detachable hook and loop fastening patches 40*a*, 40*b*, in the preferred embodiment. In the alternative embodiment, as seen in FIG. 5, the complementary snap fastening elements 42*a*, 42*b* are attached together.

The arm protective garment 20 is easily removable from the left hand 28 and arm 30 of the driver 32. The attached complementary detachable fastening elements 40*a*, 40*b* (or snap fastening elements 42*a*, 42*b* in the alternative embodiment) are detached from one another so as to detach the strap 26 at its one end 26*b* from the upper portion 22*c* of the sleeve 22 at the one open end 22*a* thereof. The thumb 28*a* is then withdrawn from through the thumb opening 24*a* so as to be enclosed by the mitten 24. The mitten 24 is then simply grasped by the right hand 44 of the driver 32 and pulled forwardly. Such action thereby pulls both the mitten 24 and sleeve 22 completely away from the left hand 28 and arm 30 of the driver 32. The arm protective garment 20 can then be folded compactly for storage until further use of the garment 20 is desired.

It should be readily apparent that the garment 20 can be made in different sizes, such as small, medium, large and extra large to accommodate persons of different sizes. Also, while the garment 20 has been described in conjunction with the left arm of a driver, it should be realized that there are other applications where a person might choose to utilize the garment 20 to protect one of his or her arms and hands from the sun or some other adverse environmental condition.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. An arm protective garment, consisting essentially of:

(a) an elongated tubular sleeve of flexible material having a pair of opposite ends and defining an elongated internal cavity extending between said opposite ends, said sleeve defining an opening at one of said opposite ends thereof for slipping over a hand and arm of a person and for receiving and enclosing the arm in said internal cavity of said sleeve up to but not including a shoulder of the person connected to the arm such that said sleeve is of a length only covering the arm and hand of the person, said opening defined at said one end of said sleeve being disposed in a generally oblique relationship to the length of the sleeve so as to define an upper portion protruding beyond a lower portion of said one end of said sleeve;

(b) a mitten defined by the other of said opposite ends of said sleeve having an internal pocket defined by a closed terminal end portion of said internal cavity of said sleeve for receiving and enclosing the hand of the person therein, said mitten having only a thumb opening defined therein on a side portion of said sleeve for permitting extension therethrough of a thumb of the enclosed hand of the person to the exterior of said mitten such that said mitten encloses all of the fingers on the hand of the person, permitting only the thumb on the hand to protrude outwardly through said thumb opening of said mitten, said mitten being formed as an integral portion of said sleeve such that said sleeve and mitten constitute a continuous tubular enclosure and said internal cavity of said sleeve and said internal pocket of said mitten communicate with one another for receiving the hand and arm of the person; and (c) an elongated flexible strap having a pair of opposite ends, one of said opposite ends of said strap being fixedly attached to said upper portion of said one end of said sleeve and the other of said opposite ends of said strap being releasably attached to said upper portion of said one end of said sleeve side by side with said one end of said strap, the portion of said strap extending between said opposite ends thereof being adapted to encircle the neck of the person adjacent to the arm of the person so as to provide the only means to releasably retain said sleeve and mitten on the arm and hand of the person.

2. The garment of claim 1 wherein said sleeve and said mitten are made of a flexible fabric capable of substantially blocking the sun's rays from penetrating therethrough.

3. The garment of claim 2 wherein said fabric is a light-colored, densely-woven fabric.

4. The garment of claim 1 wherein said elongated strap is of a length adapted for encircling the neck of the person.

5. The garment of claim 4 further comprising:

means on a free end of said strap and on said upper portion of said sleeve adjacent said one open end thereof for detachably fastening said free end of said strap to said upper portion to removably retain said sleeve and mitten on the arm and hand of the person.

6. The garment of claim 3 wherein said detachable fastening means is complementary detachable fastening elements applied on said strap and sleeve.

7. The garment of claim 6 wherein said elements are patches of hook and loop fastening material being detachably fastenable to one another.

8. The garment of claim 6 wherein said elements are snap and snap-receiving fastening elements being detachably fastenable to one another.

* * * * *